US005676464A

United States Patent [19]

Mattar

[11] Patent Number: 5,676,464

[45] Date of Patent: Oct. 14, 1997

[54] SUPPORT AND DRIVE SYSTEM FOR KITCHEN STIRRING IMPLEMENT

[76] Inventor: Simon E. Mattar, 8139 Dorchester St., Spring Valley, Calif. 91977

[21] Appl. No.: 647,796

[22] Filed: May 15, 1996

[51] Int. Cl.[6] ..... B01F 7/16

[52] U.S. Cl. ..... 366/282; 366/331

[58] Field of Search ..... 366/281–284, 366/326.1, 331; 99/348

[56] References Cited

U.S. PATENT DOCUMENTS

| | | | |
|---|---|---|---|
| 643,947 | 2/1900 | Cox | 366/281 X |
| 723,977 | 3/1903 | Barney | 366/282 |
| 1,009,304 | 11/1911 | Harding | 366/283 |
| 2,035,646 | 3/1936 | Farrington | 366/281 |

*Primary Examiner*—Charles E. Cooley

*Attorney, Agent, or Firm*—John R. Duncan; Frank D. Gilham

[57] ABSTRACT

A versatile assembly of interchangeable kitchen implements including stirring and vegetable coring implements. One embodiment includes a collar for holding an electric drive unit, the collar mountable on a pot or pan with adjustable legs. Various implements, such as paddles, whisks, vegetable coring devices, etc. can be mounted on the drive unit. Stirring implements, such as whisks may be mounted for untended stirring, either directly to the drive for rotating around one axis or through a flexible connection for both rotating and revolving in a circle. A brace may be used for helping support elongated stirring devices, such as a rod having a transversely extending stirring wire. Also, coring embodiments having a drill part for drilling a hole in an elongated vegetable, a side cutting portion for widening and hollowing the vegetable and a rounded distal end stop to prevent inadvertent drilling though the vegetable end wall.

6 Claims, 3 Drawing Sheets

SUPPORT AND DRIVE SYSTEM FOR KITCHEN STIRRING IMPLEMENT

BACKGROUND OF THE INVENTION

This invention relates to powered devices for kitchen use for stirring mixtures during cooking, coring elongated vegetables and the like.

A great many implements have been devised for mixing ingredients for use in cooking. These range from simple hand mixers using a hand cranked ring gear driving a pinion gear attached to mixing blades to large motorized mixers, either hand held or stationary extending into a rotatable mixing bowl. Also various hand and powered devices have been developed for coring or hollowing out fruit such as apples or vegetables such as eggplant.

While generally effective for mixing ingredients before cooking or for coring rounded fruit and vegetables, these prior devices tend to require the user to give constant attention to the mixing or coring device and have not been fully effective in thoroughly and automatically mixing ingredients while cooking or for coring elongated vegetables. When stirring during cooking it is necessary to stirring all of the material, reaching into pot corners and also across the bottom. Merely mixing material around at a central location is ineffective in preventing sticking and burning of material along the bottom and edges.

Attempts have been made to design kitchen mixing systems in which a mixer is mounted on the pot or bowl in which the mixing is being done, Typically, Swallow in U.S. Pat. No. 809,031 discloses a churn in which a manual mixer is mounted on a frame that extends across the top of the mixing vessel. However, this requires continuous manual mixing and the spring-loaded frame is not well held in place.

Various loose supports have been designed to support a mixer over a bowl or pot without securing the mounts to the vessel, Lambert in U.S. Pat. No. 3,810,605 shows a conventional motorized hand mixer with two telescoping rods and a hook so that the mixer can be loosely supported by a pan rim during mixing. when mixing material of stiff consistency, the mixer would be likely to move about the pan and possible fall away from the rim.

Some mixers have been mounted in a cover designed to fit a single size of pot. Dubroy shows a mixer in U.S. Pat. No. 5,372,422 mounted on a such a cover for a pot, with setscrews for securing the cover in place. However, this cover arrangement will fit only one pot diameter and the stirring means moves only about a fixed, central, drive shaft. Also, more heat from cooking will reach the motor and battery, shortening the life of those components and possibly causing the motor to burn out.

In additional to the manual fruit and vegetable coring devices of the sort described by McNeill in U.S. Pat. No. 4,763,414, various powered coring devices have been designed to core rounded fruit and vegetables. Farha et al. show a device in U.S. Pat. No. 3,780,435 using an oval blade to hollow out a fruit such as an eggplant to a uniform wall thickness. This device, while useful for hollowing large, rounded, vegetables such as eggplant, would be ineffective for hollowing elongated vegetables, such as zucchini.

Thus, there is a continuing need for improved powered kitchen implements for mixing ingredients, especially during cooking, which would fully and completely mix ingredients in a pot or pan, including mixing material in the corners of the pot and which could be securely mounted on pots having a variety of rim diameters. Further the need remains for a powered device for quickly and effectively hollowing elongated vetatables without significant risk of breaks though the skin of the vegetables.

SUMMARY OF THE INVENTION

The above-noted problems, and others, are overcome in accordance with this invention by a powered kitchen implement system basically comprising an approximately cylindrical, motorized, drive unit having an axial rotatable drive connection at one end, a collar for surrounding the drive unit, at least three legs hingedly connected to the collar at proximal ends and clamping means at the leg distal ends. Any of a number of differently configured stirring or processing devices may be used with the drive unit and support. Each stirring device includes a driven connecting means for connection to the drive unit drive connection.

The collar includes means for holding the drive unit in a desired position, extending a selected distance from the collar. In a preferred embodiments, the collar is lined with a flexible rubber-like foam material which holds the drive unit firmly in place during use and absorbs vibration while allowing manual movement of the drive unit axially through the collar. If desired, any other releasable securing means could be used, such as a conventional over-center type band clamp, set screws, a band clamp of the screw adjusted hose clamp type, etc.

The legs are preferably equally spaced around the collar and are hinged therto. The distal end clamp may be easily tightened and loosened clamp that will fit over the rim of conventional bowls and pots and clamp thereto. The legs can be easily moved inwardly and outwardly to accommodate a wide variety of pot rim diameters. This generally conical arrangement of legs and collars is inherently very strong, much stronger and stable than a flat cover-like support with extensible legs.

The drive unit is preferably a cordless electric motor driver of the sort used in cordless screwdrivers, with a rechargeable battery. If desired, a drive unit powered by alternating current mains could be used although the cordless unit is preferred for convenience and safety. Any suitable rotational speed may be used, with a variable speed motor preferred.

Any of a wide variety of implements may be used with the drive unit and support means. In a particularly preferred embodiment, a flexible connector such as a short length of rubber tubing, is included between the drive unit and the implement, such as a whisk. This flexible connector causes the implement to both revolve and to rotate in a circle. For optimum stirring the length of the flexible connector is adjusted so that the circle takes the stirring implement along a path adjacent to the corners of the pot. Typical implements include whisks, paddles, rod mounted wires, coring devices etc.

For certain implements, such as a rod connected at the proximal end to the drive unit and having an outwardly extending wire or wires (which may be formed from metal, plastic, etc.), a brace is preferably fastened to the collar for supporting the rod. The brace includes a flange with an opening coaxial with the drive unit axis of rotation and spaced from the drive connection means. The rod passes through the hole to the drive connection means and is positioned with the wire(s) adjacent to or in contact with the bottom of the pot for optimum stirring and to prevent material from sticking to the bottom of the pot and burning.

The drive unit may be used separate from the collar and support if desired. This is particularly useful when coring or hollowing elongated fruit. The coring device, preferably having a sharpened helical length an a rounded central end area, is pressed into the meat of a halved vegetable to drill a central hole. When the relatively tough end rind is reached, the rounded central end will prevent the device from penetrating though the end. The device can be manipulated sideways to further remove the meat.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
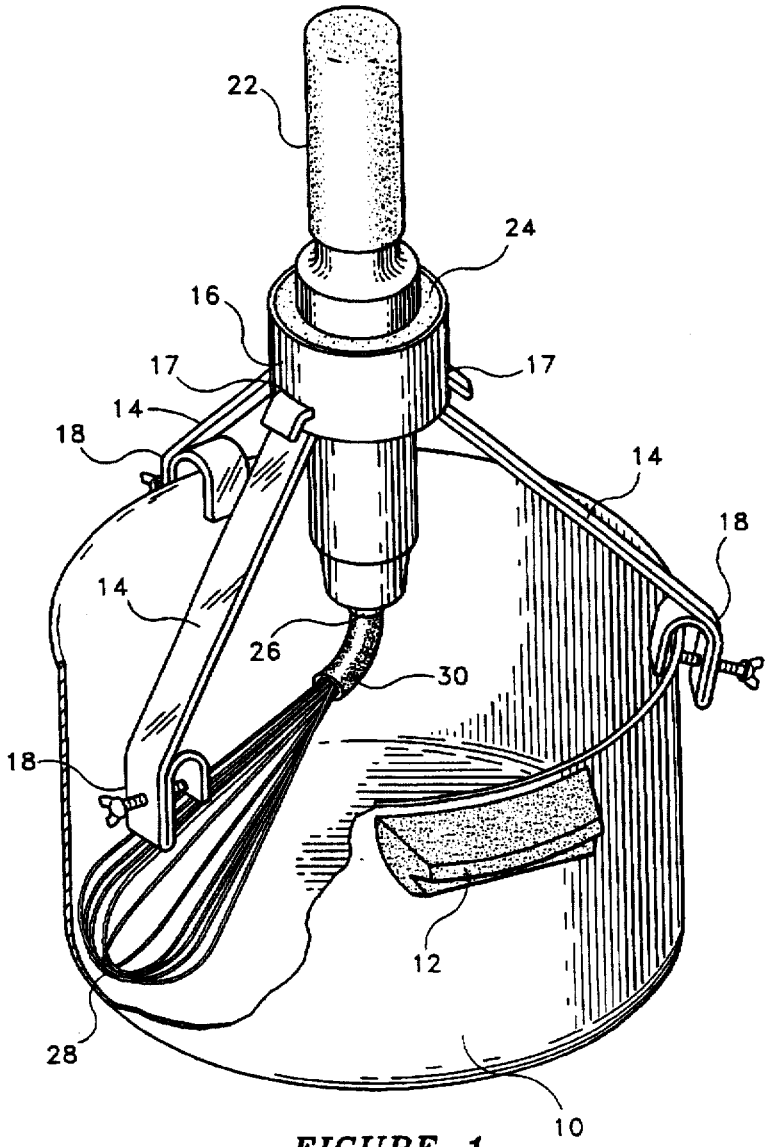
FIG. 1 is a perspective view of the assembly of drive unit and support on a typical pan.

Referring to FIG. 1, there is seen a conventional pot or pan 10, partially cut away to show a portion of the interior, typically formed from metal. Glass, enameled metal or other suitable materials could be used for pan 10. Two handles 12 are provided for lifting or moving pan 10.

Three or more legs 14 extend from a tubular collar 16 to clamping means 18. Proximal ends of legs 14 are hingedly connected to collar 16 by a simple hinge 17 detailed in FIG. 3.

Clamps 18 include an inverted U-shaped at the distal ends of legs 14. Where legs are formed from metal strap material or the equivalent, the U-shaped ends can be conveniently formed by bending the distal leg ends. The outer portion of each U-shape is drilled and tapped for a wing bolt 44. Thus, collar 16 is supported above the center of pot 10 by the three legs 14 and positively secured in place by slipping the U-shaped ends over the pot edge and tightening wing bolts 44. As is apparent, this arrangement is adaptable to a wide variety of pot or pan diameters.

Collar 16 includes means for releaseably holding a drive motor unit 22 at a selected location along the collar axis. In a preferred embodiment, collar 16 is lined with a layer of rubbery foam material 24 having a thickness such that a generally cylindrical drive unit 22 can be slid into the collar to the desired position, but will not slip during use. Alternatively, collar could have an axial slit with a conventional over-center clamp across the slit to compress collar 16 to further hold drive unit 22 in the selected position. Any other clamping means, such as conventional hose clamps could be used, if desired.

Drive motor unit 22 is preferably a conventional generally cylindrical rechargeable battery powered unit of the sort used in cordless screwdrivers. An axial drive connection 26 for holding a cylindrical, hexagonal, etc. driven connection end of an implement to be rotated is provided at a first end of drive unit 22. A Jacobs chuck, a keyless chuck or a collet for receiving a single size driven connection or the like may be used for drive connection 26. For best results, a drive connection 26 having a hexagonal cross section socket, with a spring loaded ball on the like to press against a corresponding hexagonal pin is preferred. This permits rapid placement and replacement of implements having such a hexagonal pin at the driven end.

Drive unit may rotate an implement mounted thereon at anu suitable speed. Optimally, a variable speed motor is provided so that implements can be rotated at the best speed for each type.

FIG. 1 illustrates a typical implement in use; here, a whisk 28 of generally conventional construction is seen within the cut away portion of pan 10. Whisk 28 in this embodiment has a flexible connection 30 to drive connection 26. As detailed below, there are several different arrangements for provide flexible connection 30. With flexible connection 30, whisk 28 will both revolve around the whisk centerline but will also rotate about a circle so that the entire bottom of the pan, including edge area, will be stirred. If desired, an implement such as whisk 30 can be mounted on drive connection 26 without flexible connection 30, so that the whisk will rotate only at the center of pan, which may be acceptable for some purposes, such as stirring a clear broth.

Figure 2:
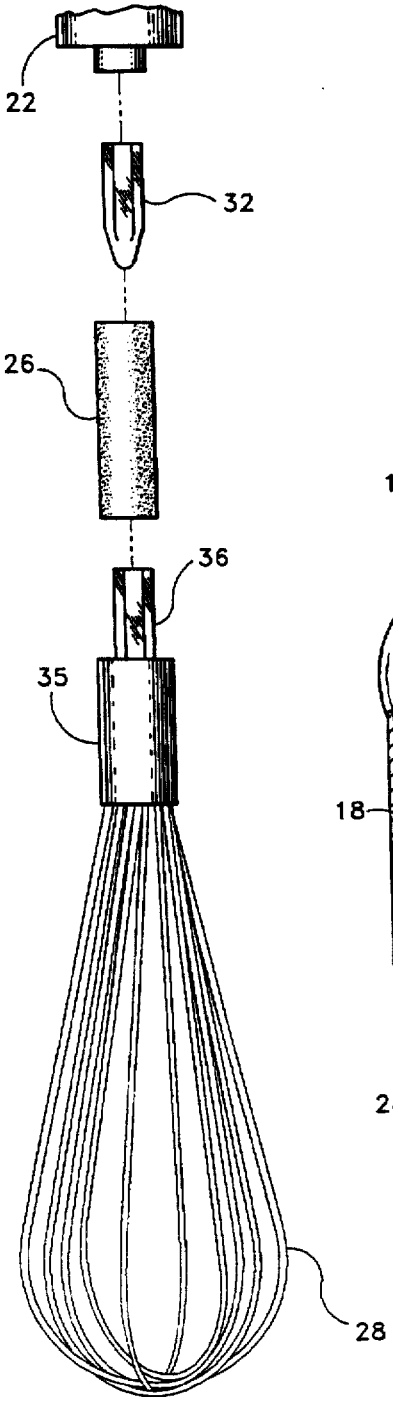
FIG. 2 is a side exploded view of a whisk and a flexible drive connection.

FIG. 2 illustrates, in an axially exploded view, a first embodiment of a flexible mounting arrangement for a stirring implement.

Drive unit 22 has a short pin 32, round or hexagonal as desired, fitted in the drive unit collet or other holding means. A flexible connection 26, typically a short (generally about 0.5 to 2 in. in length) rubber or similar material tube, sized to fit tightly over pin 32 is pushed over pin 32. The implement to be used, here a whisk 28, has a base 35 with an axially extending pin 36. When drive unit 22 is operated with whisk 28 in place, the unit will rotate the whisk and centrifugal force combined with the flexibility of connecting tube 26 will cause the distal end of the whisk to revolve along a circular path. The diameter of the circular path is governed by the vertical position of drive unit 22 within the collar and is affected by the speed of the drive unit and the distance between the ends of pins 32 and 36 within tube 26, so that the diameter can be easily adjusted by modifying drive motor position or the like.

This whisk assembly can be formed in any suitable manner. Typically, the handle end of a conventional whisk can be inserted in one end of a short metal tube 35, pin 36 can be inserted in the opposite end and the tube filled with a potting compound, such as an epoxy or polyester resin to hold the assembly together. Often commercial whisks have hollow handle portions that can serve as the tube 35 for receiving pin 36. Pin can have any suitable cross section, e.g. round or hexagonal. A hexagonal pin sized to fit in the drive unit drive connection is preferred, so that whisk 28 could be directly connected to the drive unit if desired.

Figure 3:
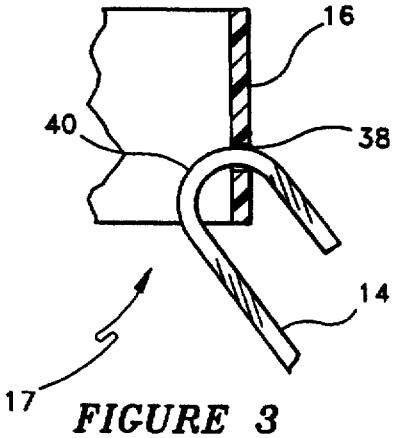
FIG. 3 is a detail section view showing the support hinge joint.

FIG. 3 is a detail section view through hinge 17. A transverse slot 38 is cut through the wall of collar 16 adjacent to the lower end at each hinge location. Slot 38 conforms to the cross section of leg 14 and is a loose fit thereover. The proximal end 40 of leg 14 is bent into a smooth, generally circular arc such that the end can be inserted from the collar interior and will remain in place when extended therefrom. This simple hinge allows positioning of legs in a conical array from a very narrow to a very wide cone to accommodate various pan 10 diameters.

Figure 4:
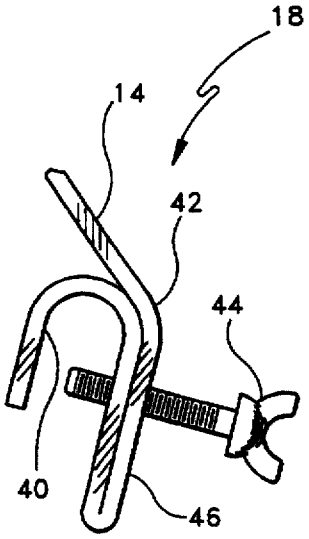
FIG. 4 is a detail side view of the support to pan clamping.

FIG. 4 is a detail side view of the clamping means at the end of each leg 14 for clamping to the rim of a pan 10. The leg material, preferably an aluminum bar or strap, is folded back along the leg, then into a generally inverted U-shaped channel 40 sized to loosely fit over a rim on a pan 10. Leg is bent to a angle, preferably about 30° to 50°, at 42 so that when the assembly is placed on a pan of average diameter, channel 40 will be approximately vertical. With larger and smaller pans, channel 40 will be angled slightly outwardly or inwardly, respectively, so that the clamp will still function properly.

A wing bolt 44 is threaded through an opening in the outer side 46 of channel 40 for rotation to clamp and unclamp the assembly. Since the outer side of channel 40 has a doubled strap thickness, there are sufficient threads for wing bolt 44 to work effectively. This effective clamping is important, since when stirring thick materials or stirring at high speeds the unit could vibrate, move about, and come off of the pan if not well secured to the pan.

Figure 5:
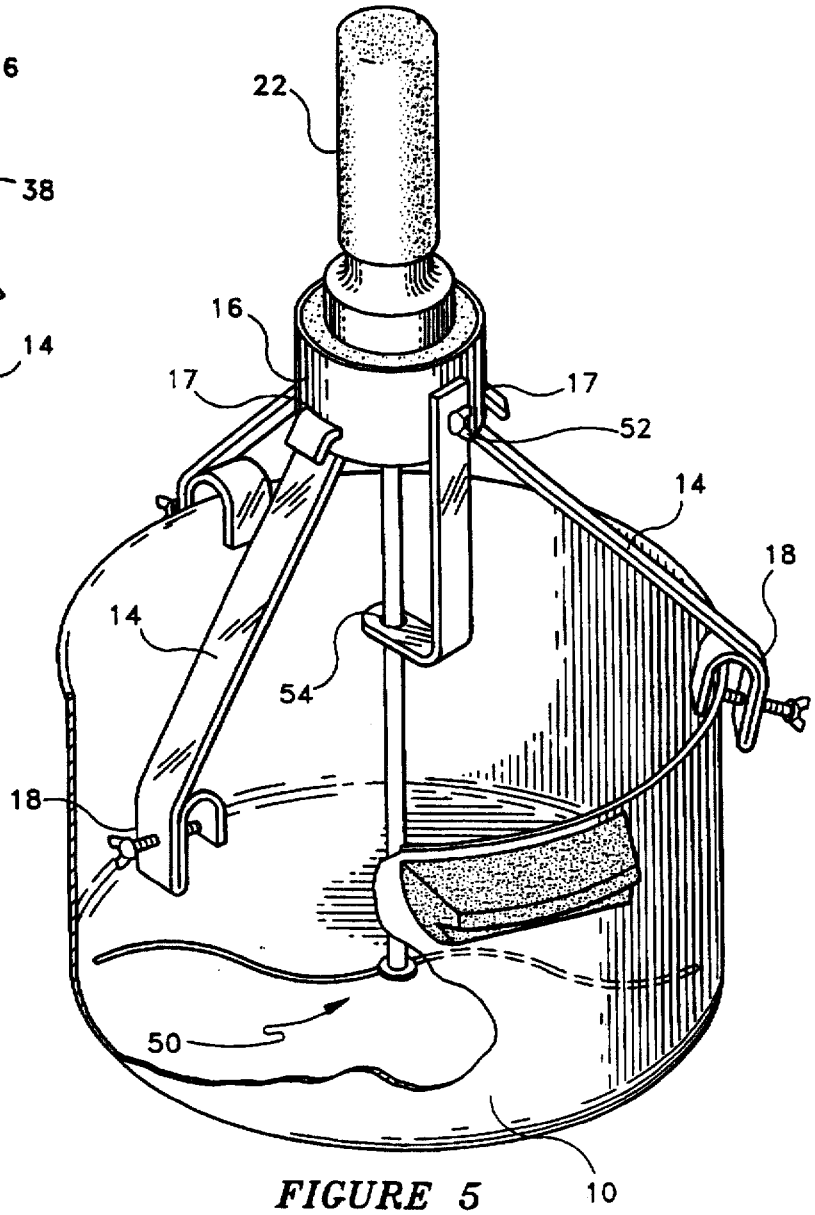
FIG. 5 is a perspective view of an embodiment with an alternate mounting and stirring means.

FIG. 5 illustrates a second embodiment of the assembly particularly suitable where the stirring implement has a long, thin shaft. In this embodiment, pan 10, legs 14, collar 16 and drive unit 22 are basically the same as in FIG. 1.

In the FIG. 5 embodiment, an L-shaped bracket 48 is fastened to collar 16 to support implement 50. Collar 16 has at least one hole through the sidewall. A bolt passes outwardly through the hole in collar 16 and bracket 48, then a wing nut 52 is threaded into the bolt to hold the bracket in place. Preferably the surface of bracket 48 in contact with collar 16 is shaped to conform to the collar contour. Two or more holes and wing bolts may be used, if desired, although a single wing bolt 44 is preferred where the bracket surface conforms to the collar surface.

Bracket 48 has a hole 54 axially aligned with the drive connection of drive unit 22. An elongated shaft on implement 50 can extend through hole 54 to stabilize rotation of the implement.

Figure 6:
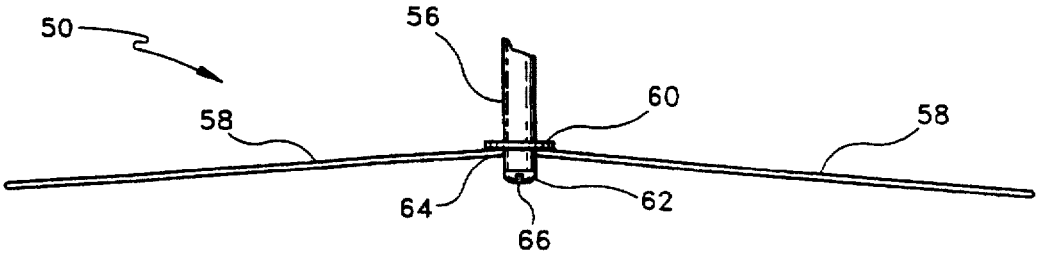
FIG. 6 is a side elevation of an implement embodiment that stirs along the pan bottom.

The implement 50 shown in FIGS. 5 and 6 includes an elongated shaft 56 with two outwardly extending wires or plastic rods 58 fastened to the shaft distal end. While two wires, as shown, are preferred one or more than two may be used, if desired. The wires 58 may be straight or slightly curved, as desired, and may be secured to shaft 56 in any desired manner. The preferred fastening means shown consists of a tapped axial hole (not seen) in the distal end of shaft 56, a washer 60 in contact with the end and a bolt 62 thread able into the axial hole. Wire 58 extends through a transverse hole 64 in bolt 60 adjacent to the bolt head. The head of bolt 62 may be rotated in any suitable manner, such as slot 66 as shown, a hexagonal head to be turned with a wrench, etc.

Preferably, wires 58 extend at an angle to shaft of from about 95° to 120° so as to engage the bottom of pot 10 during rotation for improved stirring and to prevent stirred material from sticking and burning to the pot bottom during cooking.

Figure 7:
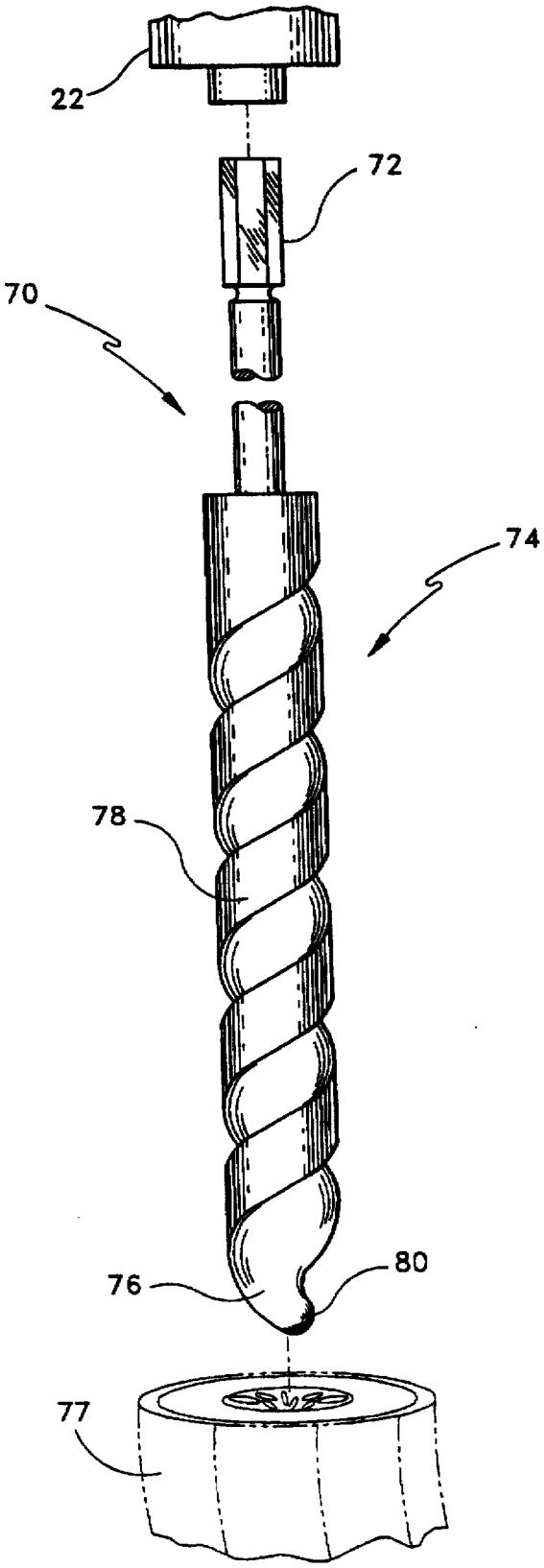
FIG. 7 is a side elevation view of a first embodiment of an implement for powered coring and hollowing of elongated vegetables.
Figure 8:
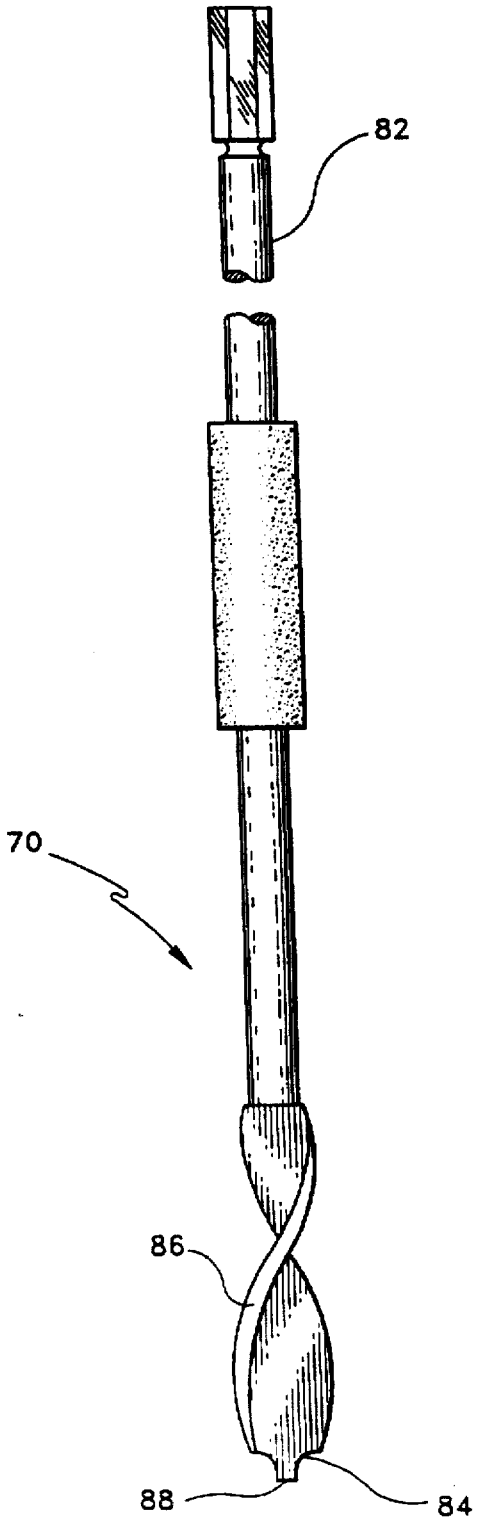
FIG. 8 is a side elevation of a second embodiment of a coring and hollowing device for elongated vegetables.

FIGS. 7 and 8 show two embodiments of an implement in the form of an auger for coring and hollowing elongated vegetables. As seen in FIG. 7, auger 70 includes a primal end 72 configured (e.g. cylindrical or hexagonal) to fit in the chuck or collet of drive unit 22. Auger 70 includes a coring and hollowing segment 74 at the distal end including a drill portion 76 for drilling a hole into the vegetable 77 (such as a zucchini, cucumber or the like), a side cutting portion in the form of a spiral sharpened rib 78 and a rounded central member 80 extending distally beyond drill 76.

The drill end portion 76 includes two sharp end surfaces having a back rake of from about 2° to 15°. This is effective for drilling though the meat of vegetable 77 without pulling the auger into the fruit with such force as to penetrate the end of the vegetable.

Spiral side cutting portion 78 has sharpened edges such as to permit auger 70 to be moved sideways after drill 76 has penetrated the desired distance into vegetable 77 to remove meat around the drilled hole to the desired extent. Since the meat of such elongated vegetables is softer than the rind, a user can easily feel when the meat is substantially removed without cutting through the rind. For best results and ease of use, it is preferred that the diameter of spiral 78 decrease adjacent to drill end 76 to about 70 to 90% of the main spiral portion.

Rounded end 80 prevents the drill from inadvertently penetrating though the end of a vegetable 77. The rounded end is easily Dressed into the meat of the vegetable during drilling, but resists penetrating the tough rind. For best results, the rounded end 80 has a diameter from about 5 to 30 percent of the diameter of the spiral rib cylinder.

In use, an elongated vegetable is typically cut in half crosswise and held in one hand and the drive unit in the other. The distal end of auger 70 is pressed against the center of the cut end, pushing rounded end 80 into the meat and drilling a central hole until the rounded end reaches the end rind. Once drilling is complete, when the user feels that the end rind has been reached, the users moves the auger around in a generally circular path to remove the desired amount of meat, out to the side rind if desired. The meat that has been extracted is shredded and can be used in cooking.

A second embodiment of auger 70 is shown in FIG. 8. This embodiment is shown for manual coring, with an elongated shaft 82 having a gripping tube, such as rubber, for gripping and manually rotating the auger.

The drilling end 84 and side cutting portion 86 are formed on a flat piece configured to have a spiral cutting edge. As discussed above, the drill cutting edge 84 preferably has a slight back rake, preferably from about up to about 15°. The side cutting edge 86 preferably lies along a cylinder, with a short end portion decreasing in diameter to from about 70 to 90% of the diameter of the balance of the cylinder. Rounded end portion 88 can be formed from the same sheet material from which the spiral portion 86 is formed. Alternately, a rounded ball like member of a plastic or other material could be secured to the distal end.

In use, the user holds the vegetable 77 in one hand and rotates the implement with the other, pushing the rounded end and drill into the meat. When the end rind is reached, the implement is rotated and revolved in a generally circular or conical path to remove the desired portion of the meat. If desired, the drill and side cutting portions of the embodiments of FIGS. 7 and 8 could each be mounted on the other shaft and drive arrangement.

while certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A versatile assembly of interchangeable kitchen implements which comprises:

an approximately cylindrical drive motor unit having a rotatable axial drive connection means at one end;

a collar for surrounding at least a portion of said drive motor unit and holding said unit at a predetermined location in said collar with said drive connection means extending a predetermined distance from said collar;

at least three approximately equally spaced legs each pivotally connected to said collar at a proximal end;

clamping means at the distal end of each leg for clamping to a container rim;

at least one stirring implement having a driven connecting means at a proximal and thereof for connection to said drive connection means for rotation thereby;

whereby said drive unit can be positioned in said collar to rotate said stirring implement at a selected distance above a bottom of said container.

2. The assembly according to claim 1 wherein said drive connection means comprises a socket having an other than round cross section, said driven connecting means comprises a pin having a first end configured to fit within said socket and a second end.

3. The assembly according to claim 2 wherein said second end of said pin is rigidly secured to the proximal end of said at least one stirring implement.

4. The assembly according to claim 2 wherein said second end of said pin is secured to a first end of a flexible member and the proximal end of at least one said stirring implement is secured to a second end of said flexible member, whereby rotating of said drive motor unit will cause a distal end of said stirring implement to simultaneously rotate and revolve along a generally circular path, a diameter of which increases with increasing drive speed.

5. The assembly according to claim 1 further including a brace secured to said collar, said brace having an opening coaxial and spaced from said drive connection means, said at least one stirring implement has said driven connecting means at the proximal end of an elongated shaft for insertion though said opening and connection to said drive connection means; said at least one stirring implement having stirring means located at the distal end of said elongated shaft.

6. The assembly according to claim 5 wherein said stirring means comprises at least one spring wire secured to said elongated shaft distal end and extending radially away from said elongated shaft distal end and slightly axially beyond said elongated shaft distal end.

* * * * *